US006928828B1

(12) United States Patent
Taras et al.

(10) Patent No.: US 6,928,828 B1
(45) Date of Patent: Aug. 16, 2005

(54) TANDEM COMPRESSORS WITH ECONOMIZED OPERATION

(75) Inventors: Michael F. Taras, Fayetteville, NY (US); Alexander Lifson, Manlius, NY (US); Thomas J. Dobmeier, Phoenix, NY (US)

(73) Assignee: Carrier Corporation, Syracuse, NY (US)

( * ) Notice: Subject to any disclaimer, the term of this patent is extended or adjusted under 35 U.S.C. 154(b) by 12 days.

(21) Appl. No.: 10/762,708

(22) Filed: Jan. 22, 2004

(51) Int. Cl.[7] ..... F25B 7/00; F25B 41/00; F25B 1/10

(52) U.S. Cl. ..... 62/175; 62/197; 62/510; 62/513

(58) Field of Search ..... 62/175, 510, 197, 62/513, 113, 117; 417/248

(56) References Cited

U.S. PATENT DOCUMENTS 4,787,211 A * 11/1988 Shaw ..... 62/117
4,876,859 A 10/1989 Kitamoto
4,947,655 A * 8/1990 Shaw ..... 62/200
5,095,712 A * 3/1992 Narreau ..... 62/113
5,522,233 A * 6/1996 Nares et al. ..... 62/193
5,768,901 A * 6/1998 Dormer et al. ..... 62/175
5,875,637 A 3/1999 Paetow
6,047,556 A 4/2000 Lifson
6,206,652 B1 3/2001 Caillat
6,820,434 B1 * 11/2004 Gutheim et al. ..... 62/175

OTHER PUBLICATIONS

Systems & Advanced Technologies Engineering S.r.l., publication entitled "Compsys—Dynamic Simulation of Gas Compression Plants", dated Jun. 12, 2002.
Copeland Europe publication entitled "Refrigeration Scroll for Parallel Applications" dated Feb. 26, 2002.

* cited by examiner

*Primary Examiner*—Marc Norman
(74) *Attorney, Agent, or Firm*—Carlson, Gaskey & Olds

(57) ABSTRACT

A refrigerant cycle includes economized tandem compressors. The refrigerant cycle is also provided with a common economizer circuit for all tandem compressors. Common manifolds communicate discharge, suction and economizer return flows within the refrigerant cycle to each of the tandem compressors. Also, an optional unloader function is provided for each of the compressors. Various arrangements allow enhanced operation control, improved system reliability and reduced equipment life-cycle cost.

9 Claims, 1 Drawing Sheet

TANDEM COMPRESSORS WITH ECONOMIZED OPERATION

BACKGROUND OF THE INVENTION

This invention relates to a refrigerant cycle having tandem compressors, wherein the tandem compressors are each provided with an economizer port and can operate within an economizer cycle.

Tandem compressor refrigerant cycles are known, and have two or more compressors compressing refrigerant and delivering it to a common discharge manifold. Similarly, these compressors are drawing refrigerant from a common suction manifold. In some arrangements, oil equalization lines connecting oil sumps of tandem compressors for oil management, and suction pressure equalization lines connecting shells of the tandem compressors are employed. The tandem compressors provide flexibility to a refrigerant cycle designer, such as allowing additional levels of capacity control by turning off some of the compressors. Moreover, in some applications that would otherwise require a very large single compressor, the tandem compressors provide design options, availability and potential cost savings.

In refrigerant cycles having a single compressor, it is also known to utilize an economizer cycle. An economizer provides system performance enhancement under certain conditions by tapping off a portion of a refrigerant flow downstream of a condenser. The tapped refrigerant is passed through a separate expansion device, and then passes through an economizer heat exchanger along with the main refrigerant flow. The tapped refrigerant cools the main refrigerant flow, such that the main refrigerant flow has a greater cooling capacity when it reaches the evaporator. The tapped refrigerant is returned to an intermediate point in the compression cycle. Furthermore, economizer cycles provide extra steps of unloading, closely matching capacity requirements, as well as enhancing operation control and reducing life-cycle cost of equipment. Additionally, when an economizer cycle is combined with various means of compressor unloading, even greater benefits can be achieved. Although economizer circuits provide additional benefits to a refrigerant cycle as described above, they have not been incorporated into refrigerant cycles having tandem compressors.

SUMMARY OF THE INVENTION

In a disclosed embodiment of this invention, a refrigerant cycle has tandem compressors, and each compressor is provided with an economizer port connected to a common economizer circuit. In a first disclosed embodiment, an economizer return manifold communicates with two economizer lines leading to the economizer ports of the individual compressors. Shutoff valves may be placed on these individual return lines. Further, it is preferable that an unloader valve is placed on a line connecting the economizer return line to a suction line. As an alternative, if the two tandem compressors are also connected by a suction pressure equalization line, the unloader valve may communicate the economizer line back to this pressure equalization line. The refrigerant cycle can operate with either one or both compressors unloaded, either one or both compressors in non-economizer operation, either one or both compressors in economized operation, and either one or both compressors in unloaded economized operation. There are thus several additional levels of capacity available.

In an alternative embodiment, it may be that only one of the two economizer return lines is provided with a shutoff valve, and a main economizer shutoff valve is placed on the common economizer manifold. In this embodiment, one of the two tandem compressors is selected to be initially moved out of economizer operation in a preferential manner. This would be the compressor with the shutoff valve on its individual economizer return line. In a lower cost alternative, only the economizer manifold includes the shutoff valve.

Further, in a lower cost embodiment, a single unloader valve may communicate each of the economizer lines back to suction or pressure equalization line. By connecting the unloader line to the economizer line, refrigerant can be effectively tapped from the intermediate compression chambers back to suction when the economizer shutoff valves are closed.

While the description above is given for only two compressors connected in the tandem arrangement, it can be extended to additional economized compressors connected to each other in the tandem arrangement.

These and other features of the present invention can be best understood from the following specification and drawings, the following of which is a brief description.

DETAILED DESCRIPTION OF THE PREFERRED EMBODIMENT

Figure 1:
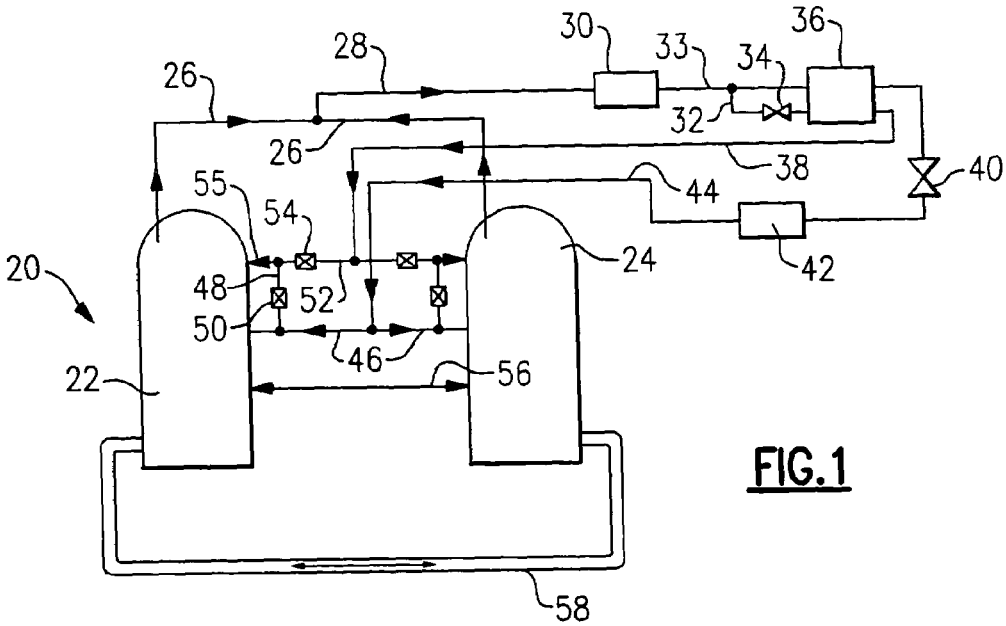
FIG. 1 is a schematic view of a refrigerant cycle including tandem compressors.

FIG. 1 shows a refrigerant cycle 20 having tandem compressors 22 and 24. Compressors 22 and 24 communicate compressed refrigerant into individual discharge lines 26 leading to a common discharge manifold 28. Downstream of discharge manifold 28, the refrigerant is delivered to a condenser 30.

An economizer tap 32 taps off of a main refrigerant line 33, downstream of condenser 30. As shown, an economizer expansion device 34 is placed on the tap line 32 upstream of an economizer heat exchanger 36. The tap line 32 and the main refrigerant flow line 33 both pass through the economizer heat exchanger 36, as known. In practice, it is preferred that the refrigerant in the tapped refrigerant line 32 move in a counter-flow relationship to the main refrigerant flow in line 33, rather than moving in the same direction as illustrated. However, for simplicity of illustration, the flows are shown in the same direction. As is known, the main refrigerant flow 33 is cooled in the economizer heat exchanger 36 by the tapped refrigerant 32. The tapped refrigerant is returned through a common economizer manifold 38 and individual economizer manifolds 52 to the individual economizer compressor ports 55 of the compressors 22 and 24. Downstream of the economizer heat exchanger 36 is a main expansion device 40, and an evaporator 42. Refrigerant is delivered from the evaporator 42 into a common suction return manifold 44. Suction return manifold 44 communicates with individual suction return lines 46 leading to both compressors 22 and 24.

Optional unloader lines 48 include unloader valves 50 communicating individual economizer return lines 52 to the individual suction lines 46 of both compressors 22 and 24. It should be noted that an alternate connection to a common suction manifold 44 is also permitted. As shown, economizer shutoff valves 54 are placed on each of the economizer return lines 52. As is known, the economizer flow is returned from manifold 38 through return line 52 and the valves 54 into economizer compressor ports 55. As is known, this refrigerant is returned at an intermediate point in the compression cycle of the compressors 22 and 24. If the valves 54 are closed and the unloader valves 50 are open, then refrigerant can move from the economizer ports 55, outwardly of the compression chambers, through the lines 48, and into the lines 46. This allows either one or both of the compressors 22 and 24 to operate in an unloaded mode.

Also, as is known, a pressure equalization line 56 can connect the low pressure side of the compressors 22 and 24 for proper oil management.

Further, an oil equalization line 58 may separately connect the compressors to additionally improve oil management for the tandem compressors.

When operating the refrigerant cycle 20, the compressors can be operated in economized mode, non-economized mode, unloaded mode and economized unloaded mode. Either or both of the compressors can be operated in any of those modes, and thus, several levels of capacity control are provided.

Figure 2:
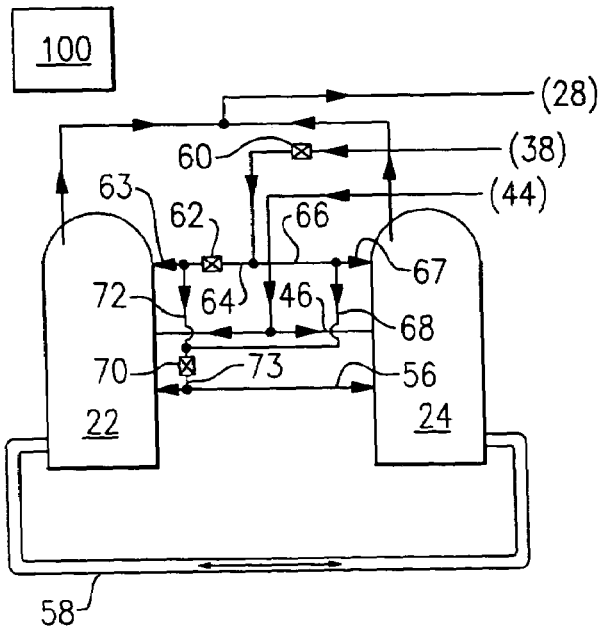
FIG. 2 shows design alternatives to the FIG. 1 embodiment.

FIG. 2 shows an alternative embodiment wherein a first economizer shutoff valve 60 is placed on the common manifold 38. A second economizer shutoff valve 62 remains on the return individual economizer line 64 for the compressor 22, and controls refrigerant flow from the manifold 38 to the economizer port 63. The other economizer return line 56 leading to the compressor 24 and the economizer injection port 67 does not have an individual shutoff valve. When control 100 controls the economized operation between the compressors 22 and 24, it may close the valve 60 to turn both compressors off of economized operation. If only one compressor is to be in an economized operation, then valve 60 is open but valve 62 is closed. In this manner, only compressor 24 is being operated in economized mode.

A unique placement of the unloader line is also shown in FIG. 2. As shown, an individual unloader connection line 68 communicates with the individual economizer return line 66 and an individual unloader connection line 72 communicates with the individual economizer return line 64. Both lines 68 and 72 lead into common unloader return line 73 having an unloader valve 70. While this type flow control may return the refrigerant to the suction line 46, it is also a design option for this flow arrangement, or for the dual unloader valve arrangement of FIG. 1, to return the refrigerant to the compressor equalization line 56 as shown in FIG. 2.

Figure 3:
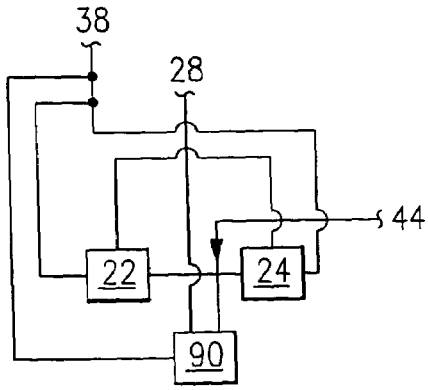
FIG. 3 schematically shows another embodiment.

As shown in FIG. 3, the above invention could extend to more than two compressors. Here, manifolds 28, 33 and 44 communicate with three compressors 22, 24 and 90. Of course, even greater numbers of compressors could be connected in this manner.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A refrigerant cycle comprising:

at least two compressors, each of said compressors receiving a suction line for delivering refrigerant to be compressed, said suction line receiving refrigerant from a common suction manifold, and each of said compressors having a discharge line for delivering a compressed refrigerant to a downstream discharge common manifold;

a first heat exchanger downstream of said discharge manifold, and an economizer heat exchanger downstream of said first heat exchanger, a refrigerant tap tapping a refrigerant line communicating said first heat exchanger to said economizer heat exchanger, and an expansion device on said tap line, upstream of said economizer heat exchanger, an economizer manifold returning said tapped refrigerant downstream of said economizer heat exchanger to each of said compressors, and an economizer return line communicating said economizer manifold to an intermediate compression point in each of said compressors.

2. A refrigerant cycle as set forth in claim 1, wherein an economizer valve controls flow of returned economizer refrigerant to at least one of said compressors.

3. A refrigerant cycle as set forth in claim 2, wherein a first economizer shutoff valve is placed upon one of said economizer return lines, with a second economizer shutoff valve being placed on said economizer manifold.

4. A refrigerant cycle as set forth in claim 1, wherein an unloader line connects said economizer return line back to a line leading into a suction side of said compressor, with an unloader valve controlling flow through said unloader line.

5. A refrigerant cycle as set forth in claim 4, wherein said unloader line communicates with a pressure equalization line communicating each of said compressor suction sides to equalize pressure on each of said compressor suction sides.

6. A refrigerant cycle as set forth in claim 1, wherein an unloader line communicates said economizer return lines to a flow line communicating with a suction side of each of said compressors.

7. A refrigerant cycle as set forth in claim 6, wherein said unloader line communicates with a pressure equalization line communicating each of said compressor suction sides to equalize pressure on each of said compressor suction sides.

8. A refrigerant cycle as set forth in claim 6, wherein a single unloader valve is placed on an unloader manifold communicating with each of said economizer return lines through separate unloader lines, and said single unloader valve controlling flow from each of said unloader lines to a line returning refrigerant to a suction chamber of said compressors.

9. A refrigerant cycle as set forth in claim 8, wherein a pressure equalization line separately communicates the compressor shells of each of said compressors, and said unloader valve returning refrigerant from said economizer return line to said pressure equalization line when said unloader valve is open.

* * * * *